US010850540B2

(12) United States Patent
Bliley et al.

(10) Patent No.: US 10,850,540 B2
(45) Date of Patent: Dec. 1, 2020

(54) PRINTER TRAY PRINTED CIRCUIT ASSEMBLY

(71) Applicant: Hewlett-Packard Development Company, L.P., Spring, TX (US)

(72) Inventors: Paul D Bliley, Vancouver, WA (US); Tyler P Kapp, Vancouver, WA (US); John P Sturman, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/331,586

(22) PCT Filed: Sep. 9, 2016

(86) PCT No.: PCT/US2016/050890

§ 371 (c)(1),
(2) Date: Mar. 8, 2019

(87) PCT Pub. No.: WO2018/048413

PCT Pub. Date: Mar. 15, 2018

(65) Prior Publication Data

US 2019/0210384 A1 Jul. 11, 2019

(51) Int. Cl.
*B41J 13/10* (2006.01)
*B41J 13/00* (2006.01)

(52) U.S. Cl.
CPC ..... *B41J 13/10* (2013.01); *B41J 13/0009* (2013.01)

(58) Field of Classification Search
CPC ..... B41J 13/0009; B41J 13/10
See application file for complete search history.

(56) References Cited

U.S. PATENT DOCUMENTS

| | | | |
|---|---|---|---|
| 5,361,085 | A | 11/1994 | Vance |
| 5,758,249 | A | 5/1998 | Dutton et al. |
| 6,249,295 | B1 | 6/2001 | Kiyohara et al. |
| 6,267,522 | B1 | 7/2001 | Slippy et al. |
| 6,527,356 | B1 | 3/2003 | Spurr et al. |
| 6,604,017 | B1 | 8/2003 | Richardson et al. |
| 6,628,316 | B1 | 9/2003 | Spurr et al. |
| 6,641,318 | B2 | 11/2003 | Yergenson |
| 7,398,969 | B2 | 7/2008 | Elenes et al. |
| 7,828,289 | B2 | 11/2010 | Mumford |
| 8,245,907 | B2 | 8/2012 | Liang et al. |
| 8,646,903 | B2 | 2/2014 | Murray et al. |

*Primary Examiner* — Lamson D Nguyen
(74) *Attorney, Agent, or Firm* — HP Inc. Patent Department

(57) ABSTRACT

A printer tray printed circuit assembly may include a board, a processing unit supported by the board, an output connector connected to the processing unit and supported by the board and an input connector supported by the board. The input connector is connectable to an interconnect to connect the first printer tray printed circuit assembly to a second printer tray printed circuit assembly. Signal altering circuitry carried by the board automatically alters an output signal of the output connector in response to the input connector being connected to the interconnect. The altered output signal indicates a configuration of a printer tray configuration.

15 Claims, 13 Drawing Sheets

PRINTER TRAY PRINTED CIRCUIT ASSEMBLY

BACKGROUND

Printer tray accessories provide or supply print media to a printer. Printer tray accessories come in a variety of sizes, shapes and configurations. Different printer tray accessories may be used to provide different print media options. For example, a printer tray accessory may have a primary print media tray, a second print media tray, a third print media tray and/or a high-capacity tray.

DETAILED DESCRIPTION OF EXAMPLES

Providing multiple different types of printers having multiple printer tray accessory configurations allows printers to better match the media demands of a user. However, providing such multiple different types of printers and multiple printer tray accessory configurations may also add complexity and cost to the manufacturing and assembling of such printers. With such printers, large inventories must be maintained to accommodate the different printer tray accessory configurations. Moreover, caution must be exercised to ensure that the printer and tray accessory are correctly set up such that the particular tray accessory being utilized is known to the printer.

The present disclosure provides a printer tray printed circuit assembly for a printer tray accessory that automatically changes its output signal to a printer based upon the particular configuration of the printer tray accessory so as to automatically indicate the configuration of the printer tray accessory to the printer. The present disclosure provides a "universal" printer tray printed circuit assembly that may be connected in series to other substantially similar or identical printer tray printed circuit assemblies depending upon the particular number or type of trays in the printer tray accessory, wherein the output signal provided to the printer will vary depending upon the number of similar or identical printer tray printed circuit assemblies in the series, indicating the configuration of the printer accessory tray to the printer. By automatically indicating the configuration of the printer tray accessory, the printer tray printed circuit assembly reduces assembly errors. By indicating the configuration of the printer tray accessory simply based upon the number of substantially similar or identical printer tray printed circuit assemblies connected in series, inventories and cost may be reduced.

Figure 1:
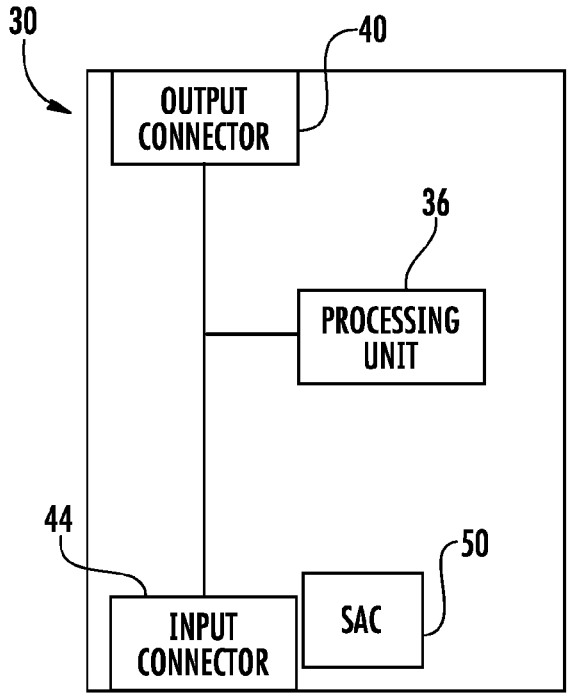
FIG. 1 is a schematic diagram of an example printer tray printed circuit assembly (PT PCA).

FIG. 1 schematically illustrates an example printer tray printed circuit assembly (PT PCA) 30 for use as part of a printer tray accessory. As will be described hereafter, PT PCA 30 may be used as part of a series of substantially similar or identical universal PT PCA's 30 that facilitate the control of the various trays of a printer tray accessory and that cooperate to automatically indicate the configuration, such as the number of trays in the printer tray accessory, to the printer. PT PCA 30 may reduce assembly error, manufacturing inventory and manufacturing costs. PT PCA 30 comprises circuit board 32, processing unit 36, output connector 40, input connector 44 and signal altering circuitry 50.

Circuit board 32 comprises an electronics platform for supporting the various components of PT PCA 30 such as processing unit 36, output connector 40, input connector 44 and signal altering circuitry 50. In one implementation, circuit board 32 comprises electrically conductive traces that transmit electrical signals between the various components on circuit board 32 and across PT PCA 30. In one implementation, circuit board 32 comprises a rigid platform. In other implementations, circuit board 32 comprises a flexible platform.

Processing unit 36 is supported by board 32 and carries out various operations by following instructions contained in a non-transitory computer-readable medium. In one implementation, processing unit 36 controls one or more operations of an assigned printer tray. For example, processing unit 36 may receive signals from one or more sensors on the tray and transmit such data to the printer. Processing unit 36 may receive signals from one or more sensors on the tray and automatically adjust operation of various components of the tray, such as a media pick mechanism, a media advancing mechanism, a media lift mechanism and the like. In some implementations, processing unit 36 receives signals or instructions from the printer, wherein the processing unit interacts with the various mechanical components or sensors of the tray pursuant to such signals or instructions from the printer. In one implementation, processing unit 36 may comprise an application specific integrated circuit.

Output connector 40 comprises electrical contact elements, such as pins, pin receptacles or contact pads, that are supported by board 32 and that facilitate the transmission of signals to recipients beyond board 32. The signals output by output connector 40 comprise signals produced by processing unit 36 as well as signals from input connector 44, if any, that are originating from another PT PCA 30 and are being passed through, across board 32. In one implementation, output connector 40 is selectively connectable to either an input connector of the printer or an input connector of another PT PCA, such as another substantially similar or identical PT PCA 30. Output connector 40 facilitates bidirectional communication between processing unit 36 and the printer, either directly, without any intervening PT PCA's 30, or indirectly, across any intervening PT PCA 30. When connected to an output connector of another PT PCA 30, output connector 40 further facilitates bidirectional communication between the other PT PCA 30 and the printer.

In one implementation, output connector 40 comprises a series or array of electrical contact pads, electrical contact pins, electrical pin receiving contacts or other types of electrical contact elements. In one implementation, connector 40 comprises a tray configuration indicating electrical contact element dedicated to outputting a tray configuration identification signal. In one implementation, output connector 40 comprises a multi-pin discrete wire connector. In one implementation, output connector 40 comprises a structure that facilitates releasable connection of the electrical contact elements to corresponding electrical contact elements of a recipient. For purposes of this disclosure, the term "releasably" or "removably" with respect to an attachment or coupling of two structures means that the two structures may be repeatedly connected and disconnected to and from one another without material damage to either of the two structures or their functioning. In one implementation, output connector 40 comprises a connector to be releasably connected to a cable.

Input connector 44 comprises electrical contact elements, such as pins, pin receptacles or contact pads, that are supported by board 32 and that facilitate the receipt of signals from recipients beyond board 32, such as additional PT PCAs connected in series. Input connector 44 is connected to output connector 40 by electric conductive signal transmitting lines 52, such as electric conductive traces supported by board or other wires or cabling. In one implementation, input connector 44 comprises electrical contact elements that are directly connected to corresponding electrical contact elements of output connector 40. For example, in one implementation, input connector 44 comprises an electrical contact element connected and corresponding to the tray configuration indicating electrical contact element of output connector 40.

In one implementation, the electrical contact elements comprise a series or array of electrical contact pads, electrical contact pins, electrical pin receiving contacts or other types of electrical contact elements. In one implementation, input connector 44 comprises a multi-pin discrete wire connector. In one implementation, input connector 44 comprises a structure that facilitates releasable connection of the electrical contact elements to corresponding electrical contact elements of another PT PCA 30. In one implementation, input connector 44 comprises a connector to be releasably connected to a cable.

Signal altering circuitry (SAC) 50 comprises electrical circuitry or electronics carried by board 32 to automatically alter an output signal of the output connector in response to the input connector being connected to the interconnect, the altered output signal indicating a configuration of a printer tray accessory. In one implementation, SAC 50 alters a characteristic of the signal being output by a tray configuration indicating electrical contact element of output connector 40. In one implementation, SAC 50 alters a voltage of the output signal. In other implementations, SAC 50 may alter other characteristics of the output signal, such as other characteristics of the signal being output by the tray configuration indicating electrical contact element. In one implementation, the main printer, when connected to the printer tray accessory, supplies power to the printer tray accessory which results in return of a printer tray accessory indicating signal.

In one implementation, SAC 50 comprises signal altering circuitry that is electrically isolated from printer tray accessory configuration indicating circuitry of PTCA 30, wherein SAC 50 is connectable to the printer tray accessory configuration indicating circuitry in response to input connector 44 being connected to the interconnect. Connection of SAC 50 to the printer tray accessory configuration indicating circuitry results in the signal output at the tray configuration indicating electrical contact element of output connector 40 being altered.

Figure 2A:
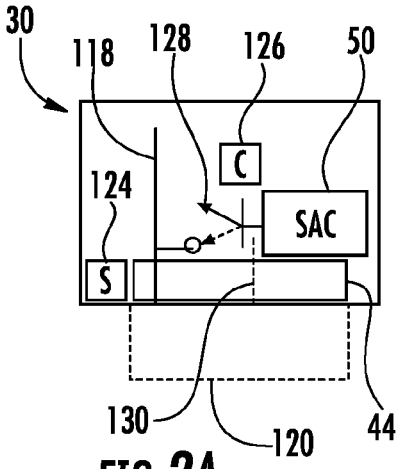
FIG. 2A is a schematic diagram of a portion of one example implementation of the PT PCA of FIG. 1.

FIG. 2A illustrates one example of PT PCA 30, wherein SAC 50 is electrically isolated from printer tray accessory configuration indicating circuitry 118 until an interconnect 120 (shown in broken lines) is connected to PT PCA 30 and automatically connects SAC 50 to the printer tray accessory configuration indicating circuitry 118. In the example shown in FIG. 2A, SAC 50 automatically changes from an isolated state with respect to the printer tray accessory configuration indicating circuitry 118 to a connected state in response to input connector 44 being connected to the interconnect 120. As schematically shown by FIG. 2A, PT PCA 30 may comprise a sensor 124 that senses a connection of the interconnect 120 to input connector 44, wherein signals from the sensor 124 are received by a controller 126 that automatically actuates a switch 128 to connect SAC 50 to the printer tray accessory configuration indicating circuitry 118 so as to alter the signal being output at the tray configuration indicating electrical contact element.

As indicated in broken lines in FIG. 2A, in another implementation, sensor 124 and controller 126 may be omitted, wherein switch 128 automatically connects SAC 50 to the printer tray accessory configuration indicating circuitry 118 in response to receiving an electrical signal or voltage from electrical contact element or pin 130 associated with interconnect 120. For example, switch 128 may comprise a transistor which closes in response to receiving a voltage signal from a pin of interconnect 120 that connects to the transistor when interconnect 120 is connected to input connector 44.

Figure 2B:
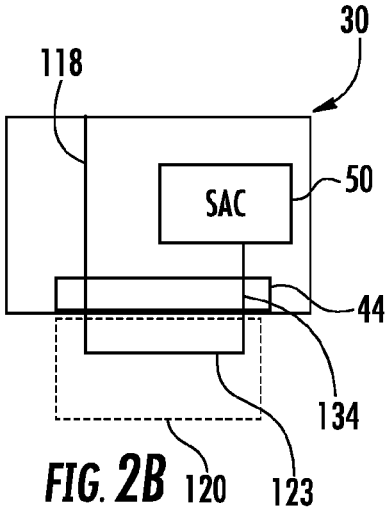
FIG. 2B is a schematic diagram of a portion of another example implementation of the PT PCA of FIG. 1.

As schematically shown by FIG. 2B, in yet another implementation, SAC 50 may comprise an electrical contact element 134 as part of input connector 44, wherein the interconnect 120 comprises a looping back electrically conductive wire or trace 123 that connects to the electrical contact element 134 of SAC 50 when the interconnect 120 is connected to input connector 44 and wherein the looping back electrically conductive wire or trace 123 also connects to the printer tray accessory configuration indicating circuitry 118 when the interconnect is connected to input connector 44. For example, a cable serving as the interconnect may include an internal electrical wire or electrically conductive trace connecting two electrical contact elements of the cable: a first contact element that makes contact with the electrical contact element 134 of SAC 50 and a second electrical contact element that makes contact with an electric contact element of input connector 44 that is connected to the printer tray accessory configuration indicating circuitry 118.

Figure 3:
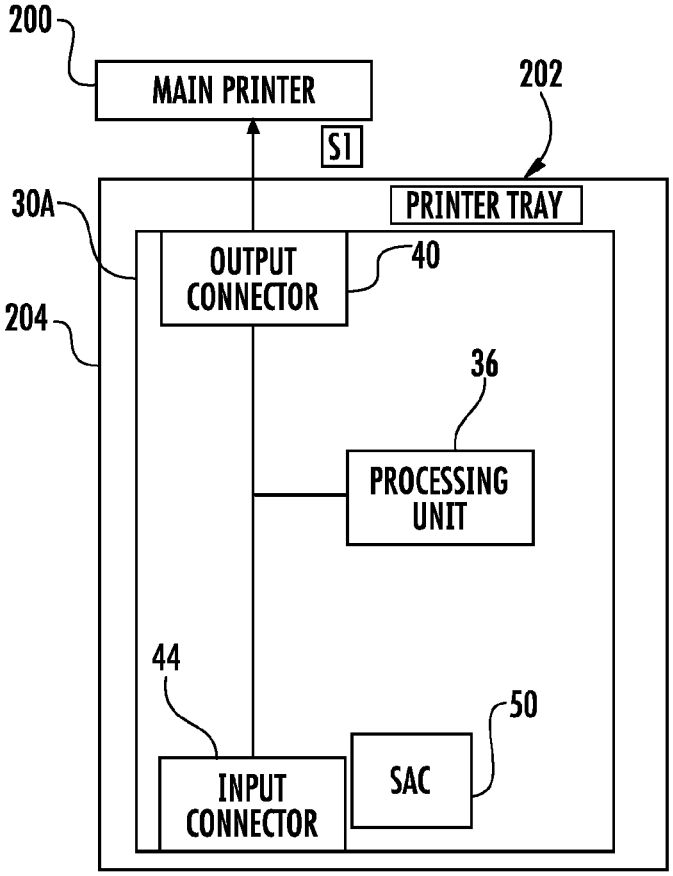
FIG. 3 is a schematic diagram of an example printer tray accessory connected to an example printer.
Figure 4:
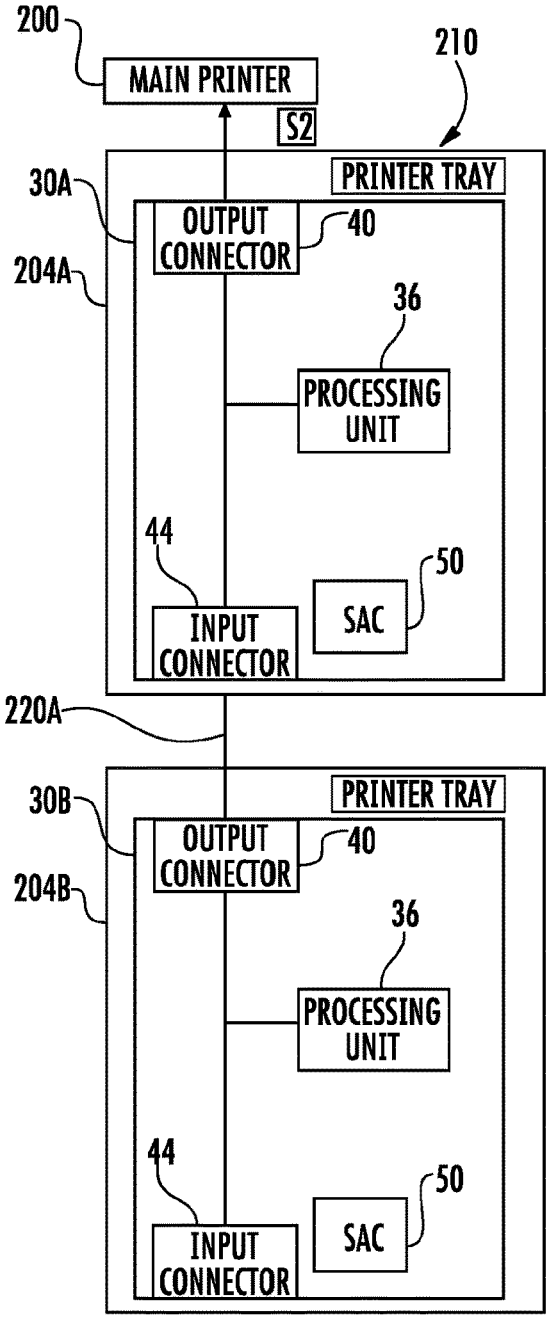
FIG. 4 is a schematic diagram of an example printer tray accessory connected to an example printer.
Figure 5:
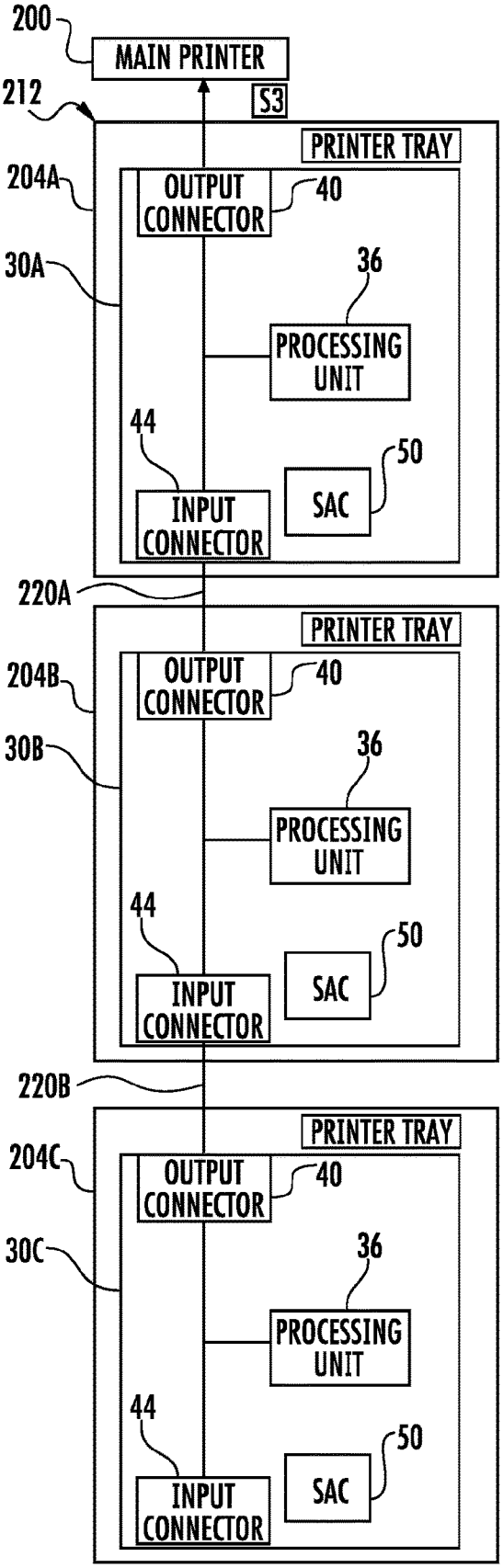
FIG. 5 is a schematic diagram of an example printer tray accessory connected to an example printer.

FIGS. 3-5 schematically illustrate the automatic indication of different printer tray accessory configurations or arrangements using different combinations of the same or substantially the same PT PCA 30. FIG. 3 schematically illustrates an example printer 200 which is supplied with print media by a printer tray accessory 202 having a single printer tray 204. Printer 200 comprises a print engine or print mechanism that prints upon sheets of media supplied by tray 204. In one implementation, printer 200 comprises a page-wide-or a printer having printing elements that span across an entire dimension of the sheets of print media being printed upon. In another implementation, printer 200 comprises a scanning printer in which a print head is scanned are moved back and forth across the print medium being printed upon. In another implementation, printer 200 comprises a drop on demand fluid jet printer in which droplets of printing fluid or selectively ejected through nozzles. Examples of such printers include inkjet printers that may include thermal resistive or piezo-resistive elements to selectively expel ink or other printing fluid through nozzle openings. In another implementation, printer 200 may comprise a liquid electrophotography printer or a dry toner electrophotography printer. In yet other implementations, Main printer 200 may comprise other print engines applying other printing technologies.

Printer tray accessory 202 is connected to main printer 200 and supplies print media to main printer 200. In one implementation, main printer 200 may already have a media supply tray, wherein printer tray accessory 202 supplements the existing tray, providing additional print media options for main printer 200. In yet other implementations, printer tray accessory 202 may be the sole source of print media for main printer 200. In the example illustrated, printer tray accessory 202 comprises a single tray 204 for containing a single type of print media.

Printer tray 204 comprises a tray, basin or other volume in which a stack of sheets of a print media are contained and supplied to main printer 200. Printer tray 204 may include various electronics and components which carry out various operations in response to a command from main printer 204 print media. For example, printer trays 204 may comprise media singulation components such as a tray lift mechanism which raises sheets of media in the tray and a pick tire that separates or picks a raised individual sheet from the stack of sheets. Printer tray 204 may additionally include sensors that communicate status information to main printer 200. For example, printer tray 204 may comprise sensors that indicate to main printer 200 the presence of tray 204, that indicate whether a door of tray 204 is opened or closed, that indicate the presence or absence of media within tray 204, that indicate a media jam within tray 204 and/or that indicate dimensions of the media within tray 204.

Printer tray 204 comprises a single associated PT PCA 30A. Processing unit 36 of PT PCA 30A assists in controlling the various components of printer tray 204 in response to commands from main printer 200. For example, processing unit 36 may assist in controlling the media lift and/or pick tire of the tray 204. Processing unit 36 may additionally facilitate communication of printer tray status information to main printer 200. Such communications are made through the transmission of signals across output connector 40 to main printer 200.

As shown by the example in FIG. 3, printer tray accessory 202 comprises just a single tray 204. As a result, input connector 44 is not connected to an interconnect. As a result, signal altering circuitry 50 does not alter the signal being output an output connector 42. In particular, signal altering circuitry 50 does not alter the base signal S1 provided to main printer 200 at the printer tray configuration electrical contact element of output connector 40. In one implementation, SAC 50 on PT PCA 30 remains isolated or electrically disconnected from the remaining tray components comprising processing unit 36, output connector 40 and input connector 44. The unaltered base signal S1 indicates to main printer 200 that printer tray accessory 202 with a single printer tray 200 is presently connected to main printer 200. As a result printer 200 may communicate and appropriately utilize the various print media options for printing given the identified presence of printer tray accessory 202.

FIG. 4 schematically illustrates an example printer 200 which is supplied with print media by a printer tray accessory 210 having two printer trays 204A, 204B (collectively referred to as printer trays 204). In one implementation, the two printer trays 204 are removably mounted within bays of a module frame, forming a single printer tray accessory module or unit for use with a main printer. Each of printer trays 204 is similar to printer tray 204 described above. Trays 204A and 204B comprise PT PCAs 30A and 30B (collectively referred to as PT PCAs 30), respectively, connected to one another by interconnect 220A. In one implementation, PT PCAs 30 are identical to one another.

Interconnect 220A connects output connector 40 of PT PCA 30B to the input connector 40 of PT PCA 30A. As a result of interconnect 220A being connected to input connector 44 of PT PCA 30A, SAC 50 of PT PCA 30 alters the signal being output to main printer 200 at output connector 40 of PT PCA 30A. In particular, signal altering circuitry 50 alters the signal provided to main printer 200 at the printer tray configuration electrical contact element of output connector 40 from signal S1 (shown in FIG. 3) to a different signal S2. In one implementation, SAC 50 on PT PCA 30A changes from an isolated state to a connected state in response to the connection of interconnect 220A to the input connector 44 of PT PCA 30A. The altered signal S2 indicates to main printer 200 that printer tray accessory 210 with two printer trays 204 is presently connected to main printer 200. As a result printer 200 may communicate and appropriately utilize the various print media options for printing given the identified presence of printer tray accessory 210.

In one implementation, interconnect 220A may comprise a cable having a first end releasably or removably connected to input connector 44 of PT PCA 30A and a second opposite end releasably or removably connected to the output connector 40 of PT PCA 30B. In another implementation, interconnect 220A may be releasably or removably mounted to output connector 40 of PT PCA 30B or tray 204B. In some implementations, interconnect 220A may be fixedly connected to output connector 40 of tray 204B. For example, in some implementations, the output connector 40 of each PT PCA 30A, 30B may be fixedly or permanently associated with interconnect 220A, wherein portions of interconnect 220A that connect to another PT PCA 30 are not utilized when the interconnect 220 of the particular PT PCA 30 is directly connected to main printer 200.

As disclosed above, in some implementations, interconnect 220A may comprise an internal electrical wire or electrically conductive trace connecting two electrical contact elements of the interconnect 220A: a first contact element that makes contact with the electrical contact element of SAC 50 and a second electrical contact element that makes contact with an electrical contact element of input connector 44 that is connected to the tray configuration indicating electrical contact element of output connector 40. In implementations where interconnect 220 is fixedly provided as part of each PT PCA 30, the first electrical contact element of interconnect 220 associated with the particular PT PCA 30 that is directly connected to main printer 200 remains disconnected or unused.

FIG. 5 schematically illustrates an example printer 200 which is supplied with print media by a printer tray accessory 212. Printer tray accessory 212 is similar to printer tray accessory 210 except that printer tray accessory 212 comprises an additional printer tray 204C carrying in additional PT PCA 30C which is connected to PT PCA 30B of tray 204B by an additional interconnect 220B. In one implementation, the additional printer tray 204C is similar to printer tray 204 described above. In other implementations, the additional printer tray 204C maybe different than that of trays 204A and 204B, having a different capacity or providing differently sized media. The additional PT PCA 30C carried by tray 204C is substantially similar or identical to the PT PCAs 30 of trays 204A and 204B.

Interconnect 220B connects output connector 40 of PT PCA 30C to the input connector 40 of PT PCA 30B. As a result of interconnect 220B being connected to input connector 44 of PT PCA 30B, SAC 50 of PT PCA 30 alters the signal being output to main printer 200 at output connector 40 of PT PCA 30A. In particular, signal altering circuitry 50 of PT PCA 30C alters the signal provided to main printer 200 at the printer tray configuration electrical contact element of output connector 40 from signal S2 (shown in FIG. 4) to a different signal S3. In one implementation, SAC 50 on PT PCA 30B changes from an isolator disconnected state to a connected state with respect to the printer tray can accessory configuration indicating circuitry and its printer tray configuration indicating contact element automatically in response to connection of interconnect 220B to input connector 44 of PT PCA 30B. The altered signal S3 indicates to main printer 200 that printer tray accessory 210 with three printer trays 204 is presently connected to main printer 200. As a result printer 200 may communicate and appropriately utilize the various print media options for printing given the identified presence of printer tray accessory 212.

In one implementation, interconnect 220B is similar or identical to interconnect 220A. In one implementation, interconnect 220B may comprise a cable having a first end releasably or removably connected to input connector 44 of PT PCA 30B and a second opposite end releasably or removably connected to the output connector 40 of PT PCA 30C. In another implementation, interconnect 220B may be releasably or removably mounted to output connector 40 of PT PCA 30C or tray 204C. In some implementations, interconnect 220 may be fixedly connected to output connector 40 of tray 204C. For example, in some implementations, the output connector 40 of each PT PCA 30A, 30B may be fixedly or permanently associated with interconnect 220B, wherein portions of interconnect 22B that connect to another PT PCA 30 are not utilized when the interconnect 220B of the particular PT PCA 30 is directly connected to main printer 200.

As disclosed above, in some implementations where SAC 50 is initially isolated from the printer tray accessory configuration indicating circuitry or contact element, interconnect 220B may comprise an internal electrical wire or electrically conductive trace connecting two electrical contact elements of the interconnect 220B: a first contact element that makes contact with the electrical contact element of SAC 50 and a second electrical contact element that makes contact with an electric contact element of input connector 44 that is connected to the tray configuration indicating electrical contact element of output connector 40.

As illustrated by FIGS. 3-5, PT PCAs 30 facilitate the construction of different printer tray accessories 202, 210 and 212 using substantially the same or identical PT PCA's 30. Different printer tray accessories may be constructed by simply connecting any number of the "universal" PT PCAs 30, associated with different individual printer trays of the accessory, in series. PT PCAs 30 facilitate constructing different printer tray accessories in a building-block fashion utilizing a single denominator PT PCA 30. As a result, rather than having to manufacture and inventory multiple different PT PCAs for different trays and different printer tray accessory configurations, a single PT PCA 30 may be constructed and inventoried, reducing cost.

Moreover, PT PCAs 30 may simplify the assembly and set up of such different printer tray accessories 202, 210 and 212, reducing the likelihood of assembly and set up error. The differentiation between different printer tray accessory configurations does not involve any operator or assembler intervention. The mere connection of one PT PCA 30 associated with a first tray to another PT PCA 30 associated with a second tray automatically alters or changes the final signal being output to the main printer 200 depending upon the selected number of media trays and their series of interconnected PT PCAs. This final signal indicates the particular configuration of the printer tray accessory to the main printer 200.

Figure 6:
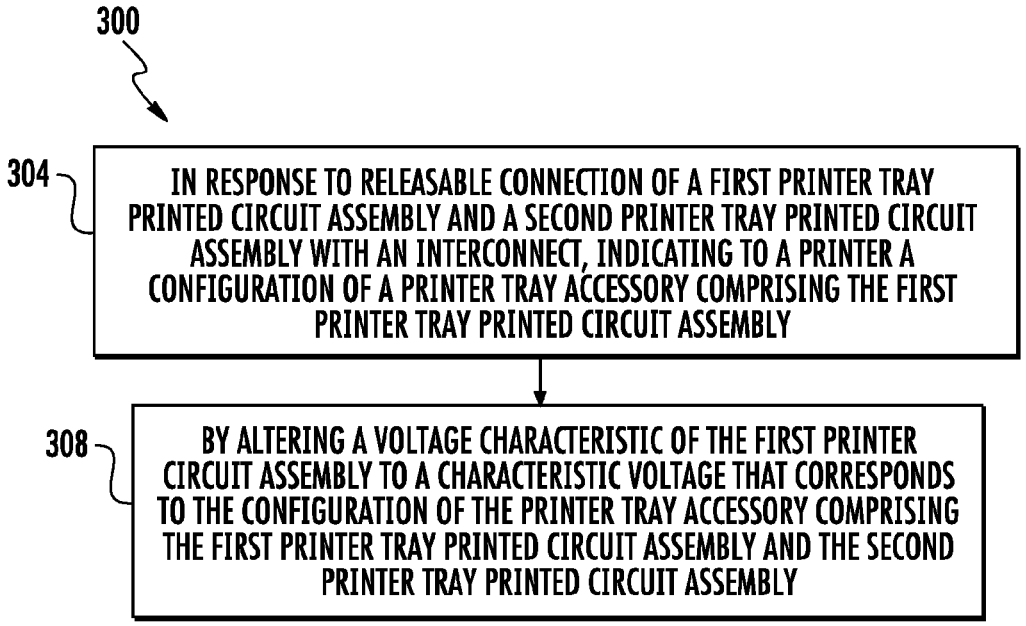
FIG. 6 is a flow diagram of an example method for constructing a printer tray accessory.

FIG. 6 is a flow diagram of an example method 300 for assembling and/or setting up a printer tray accessory for a printer. Although method 300 is described in the context of constructing printer tray accessory 210, described above, it should be appreciated that method 300 may be carried out are repeated so as to construct any of the printer tray accessories and their associated printers described in this disclosure.

As indicated by block 304, in response to releasable connection of a first printer tray printed circuit assembly 30A and a second printer tray printed circuit assembly 30B with an interconnect 220A, a configuration of a printer tray accessory 210 comprising the first printer tray printed circuit assembly 30A and the second printer tray printed circuit assembly 30B is indicated to a printer 200.

As indicated by block 308, the indication of the configuration of the printer tray accessory 210 to the printer 200 is by altering a voltage characteristic of the first printer tray printed circuit assembly 30A to a characteristic voltage that corresponds to the configuration of the printer tray accessory 210 comprising the first printer tray printed circuit assembly 30A and the second printer tray printed circuit assembly 30B. Blocks 304 and 308 may be repeated as additional media trays and their associated PT PCAs 30 are added to the printer tray accessory and additional PT PCAs 30 are connected in series. For example, as illustrated with respect to FIG. 5, in response to releasable connection of the second printer tray printed circuit assembly 30B and a third printer tray printed circuit assembly 30C with a second interconnect 220B, a voltage characteristic of the first printer tray printed circuit assembly may further be altered to a second characteristic voltage that corresponds to the configuration of the printer tray accessory 212 comprising the first printer tray printed circuit assembly 30A, the second printer tray printed circuit assembly 30B and the third printer tray printed circuit assembly 30C.

Figure 7:
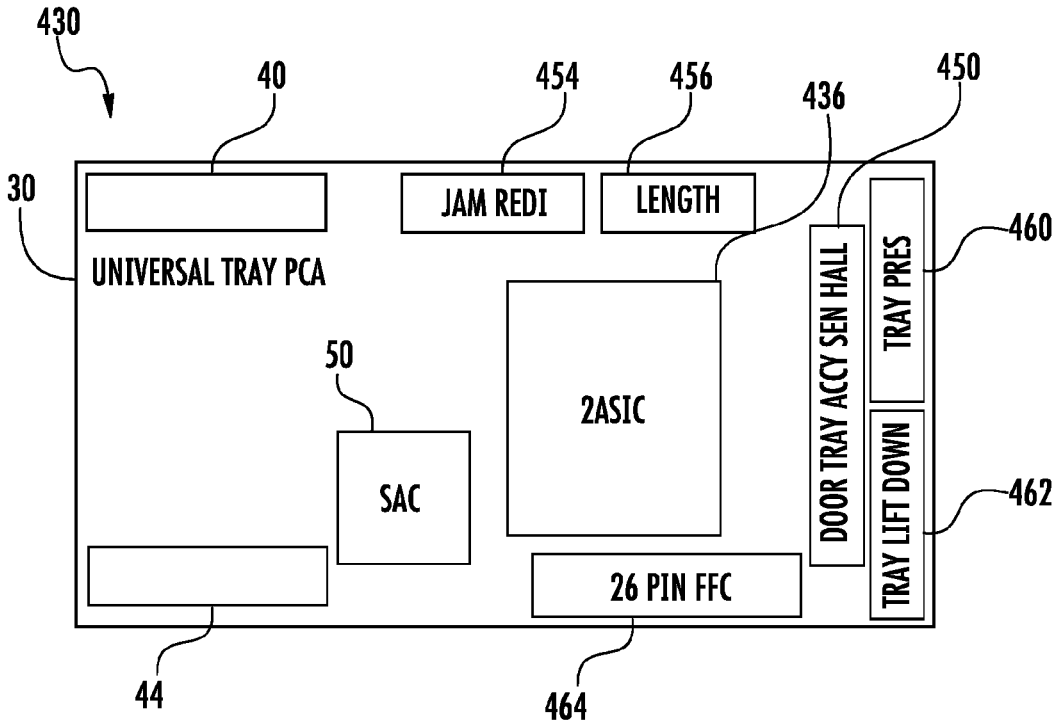
FIG. 7 is a schematic diagram of an example PT PCA.

FIG. 7 schematically illustrates PT PCA 430, an example implementation of PT PCA 30 described above. PT PCA 430 is similar to PT PCA 30 described above except that PT PCA 30 specifically comprises processing unit 436 and additionally comprises connectors 454, 456, 458, 460, 462 and 464. Those remaining components of PT PCA 430 that correspond to components of PT PCA 30 are numbered similarly.

Processing unit 436 is similar processing unit 36 except the processing unit 436 60 comprises an application specific integrated circuit (ASIC) for carrying out sensing and control functions of the particular printer tray in which PT PCA 430 is utilized. Processing unit 436 is electrically connected to each of connectors 454, 456, 458, 460, 462 and 464 by electrical conductive lines, such as wires or electrically conductive traces carried by board 30. Processing unit 436 further communicates with a main printer via output connector 40.

Connectors 454, 456, 458, 460, 462 and 464 comprise electrical contact elements, such as electrical contact pads or pins, supported by board 30. Connectors 454, 456, 458, 460, 462 and 464 connect processing unit 436 to various mechanical components or sensors of the printer tray in which PT PCA 430 is utilized. In the example illustrated, connector 454 (Jam Redi) facilitates connection to sensors that sense the positioning and/or movement of media within the associated printer tray, indicating jams of print media in the associated printer tray. Connector 456 (Length) connects to sensors that detect the length of media within the associated tray. Connector 458 (Door tray accy) connects to sensors that detect an open or closed state of the tray door. Connector 460 (Tray Pres) connects to a sensor that output signals indicating the presence of the associated printer tray, indicating whether the particular tray has been removed from the bay. Connector 462 (tray lift down) connects to a sensor or sensors that detect the positioning of the tray lift, the device that raises and lowers the stack median the tray. Connector 464 provides a connection for other printed circuit assemblies carried by the tray. In the example illustrated, connector 464 comprises a 26 pin connector.

FIGS. 8-16 illustrate the use of a universal PCA set 503 (shown in FIGS. 10, 12, 14 and 16) in each of multiple different printer tray accessory configurations. Universal PCA set 503 comprises PT PCA 30, singulation PCA 506 and OOP and lift plate sensor PCA 508. Universal PCA set 503 may be used for each tray in each printer tray configuration, reducing inventory and reducing assembly cost and complexity.

Figure 8:
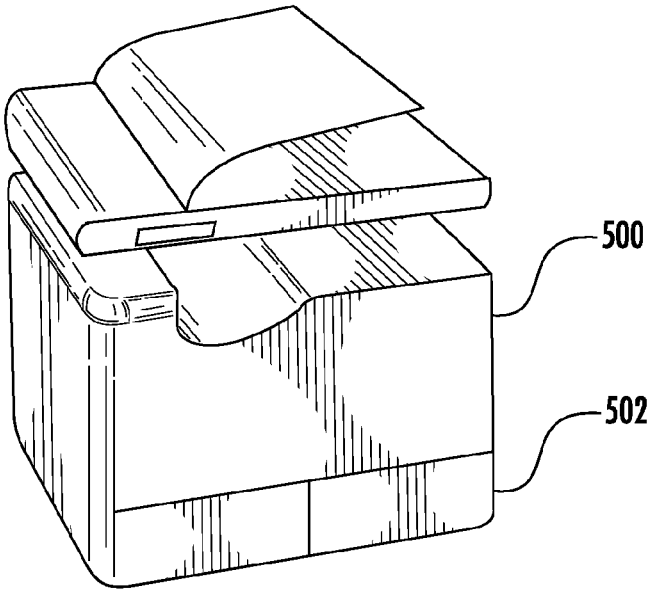
FIG. 8 is a perspective view of an example printer and printer tray accessory.
Figure 9:
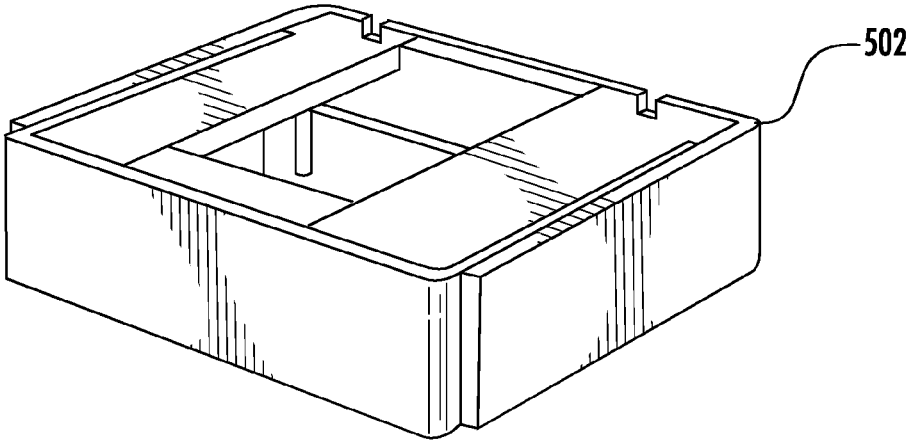
FIG. 9 is a perspective view of the printer tray accessory of FIG. 8.
Figure 10:
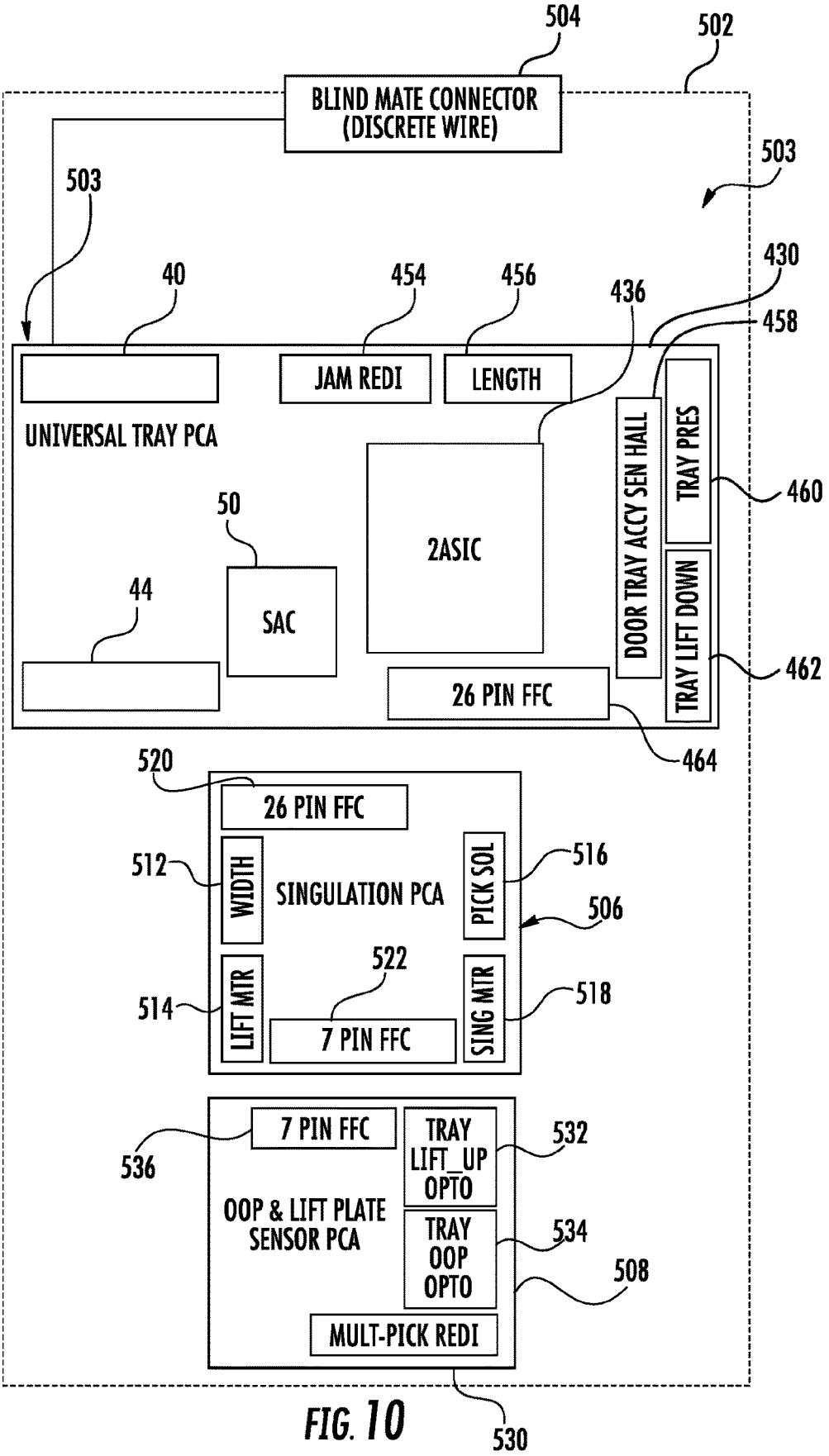
FIG. 10 is a schematic diagram of an example universal printed circuit assembly set, including the example PT PCA of FIG. 7, of the printer tray accessory of FIG. 9.

FIG. 8 is a perspective view of one example of a main printer 500 having printer tray accessory 502. FIG. 9 is a perspective view of the printer tray accessory 502 separated from main printer 500. FIG. 10 is a schematic diagram of tray 502. As shown by FIG. 10, tray 502 comprises blind mate connector 504 and universal PCA set 503.

Blind mate connector 504 comprises a connector to connect to main printer 500. Blind mate connector 504 is connected to output connector 40 of PT PCA 430 so as to transmit signals therebetween. In one implementation, blind mate connector 504 comprises a discrete wire connector. In other implementations, blind mate connector 504 may have other configurations.

Singulation PCA 506 comprises a printed circuit board assembly supporting various connectors for components of printer tray 502 associated with the simulation of print media in the tray. Singulation PCA 506 comprises connectors 512, 514, 516, 518, 520 and 522. Connector 512 comprises a connector connected to sensors that detect the width of media within the printer tray. Connector 514 comprises a connector connected to a lift motor of the tray, the motor that lifts the tray. Connector 516 comprises a connector connected to a sensor or sensors associated with the positioning of the pick tire of the tray. Connector 518 comprises a connector connected to a singulation motor of the tray, the motor that drives the pick tire of the tray. Connector 520 comprise a connector to be connected to connector 464 of PT PCA 430, forwarding signals from PCA 506 to processing unit 436 (the ASIC) of PT PCA 430. Connector 522 comprises a connector facilitating connection of PC 506 to additional PCAs, namely, PCA 508.

Out of paper and lift plate sensor PCA 508 comprises a circuit board supporting various connectors for being connected to components related to the sensing of paper within the media tray and positioning of the lift plate of the tray. PCA 508 comprises connectors 530, 532, 534 and 536. Connector 530 (MULTI-PICK REDI) comprise a connector to be connected to sensors that sense of positioning of media along a paper path within the associated tray. Connector 530 facilitates the detection of a media jam within the tray itself. Connector 532 (Tray Lift_Opto) comprises a connector connected to a sensor that determines the positioning of the lift tray. Connector 534 comprises a connector connected to a sensor that indicates the presence of media in the tray (OOP, out of paper). Connector 536 comprises a connector to be connected to connector 522 of PCA 506, wherein signals from PCA 508 may be relayed by PCA 506 via connector 520, to processing unit 436.

Figure 11:
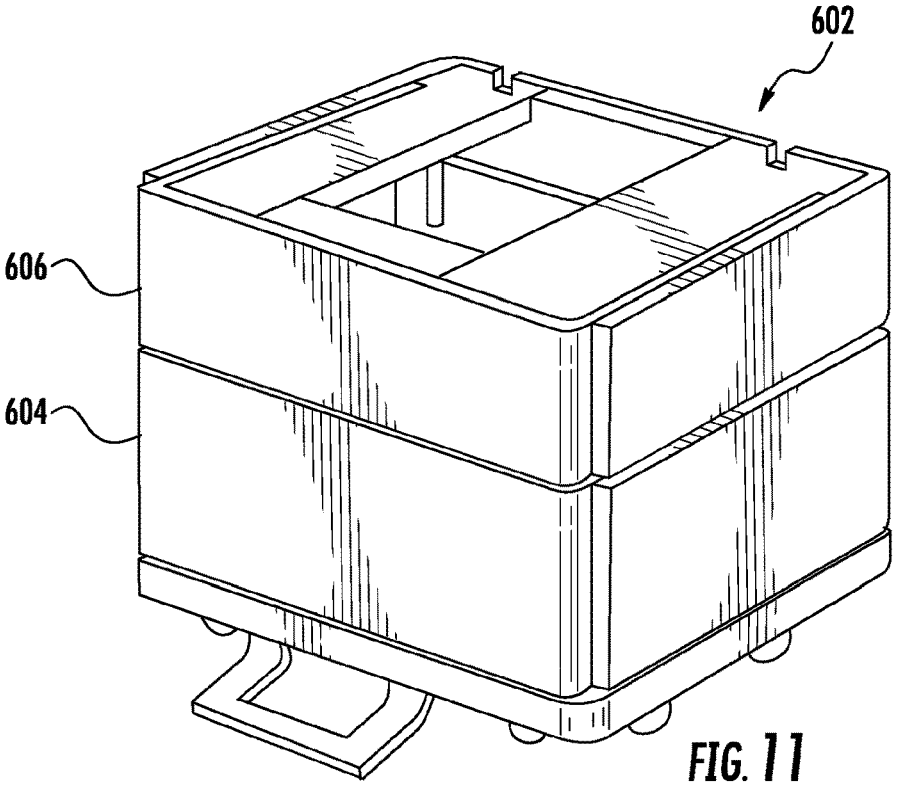
FIG. 11 is a perspective view of an example printer tray accessory.
Figure 12:
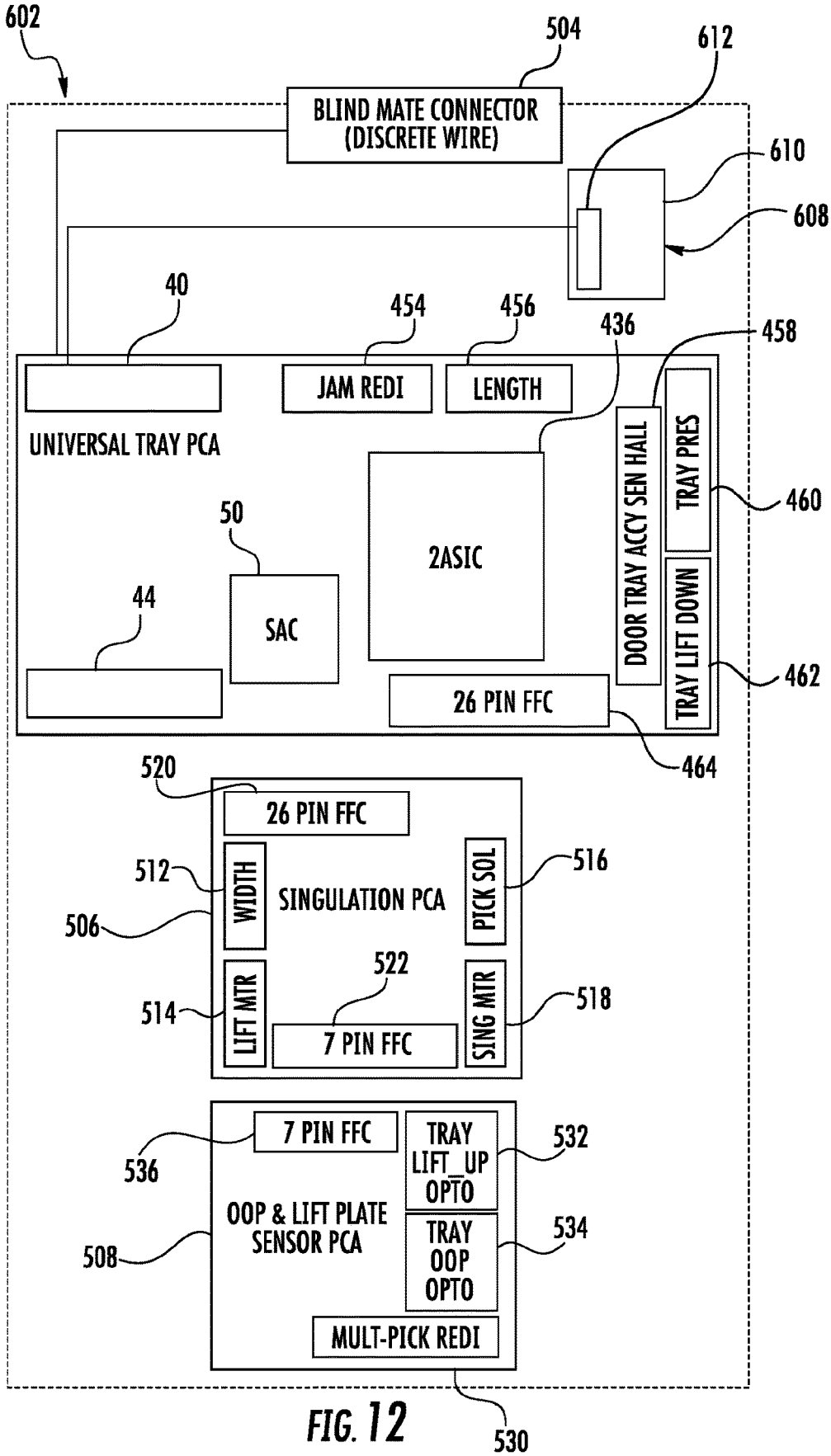
FIG. 12 is a schematic diagram of the example universal printed circuit assembly set of FIG. 10 and a cart indicating PCA of the printer tray accessory of FIG. 11.

FIGS. 11 and 12 illustrate printer tray accessory 602 for use with main printer 500 (shown in FIG. 8). Printer tray accessory 602 comprises cart 604 and media tray 606. Cart 604 supports printer tray 606 and the main printer 500 supported on top of media tray 606. Printer tray accessory 602 utilizes universal set 503 and an additional cart indicating printed circuit assembly 608. Those remaining components of printer tray 606 that correspond to components of printer tray accessory 502 are numbered similarly.

Cart indicating PCA 608 comprises a circuit board 610 supporting electronic circuitry 612 that outputs a signal indicating the presence of cart 604. In the example illustrated, circuitry 612 outputs a signal which is transmitted to one of the electrical contact elements of connector 40, indicating to the main printer 500 the additional presence of cart 604.

Figure 13:
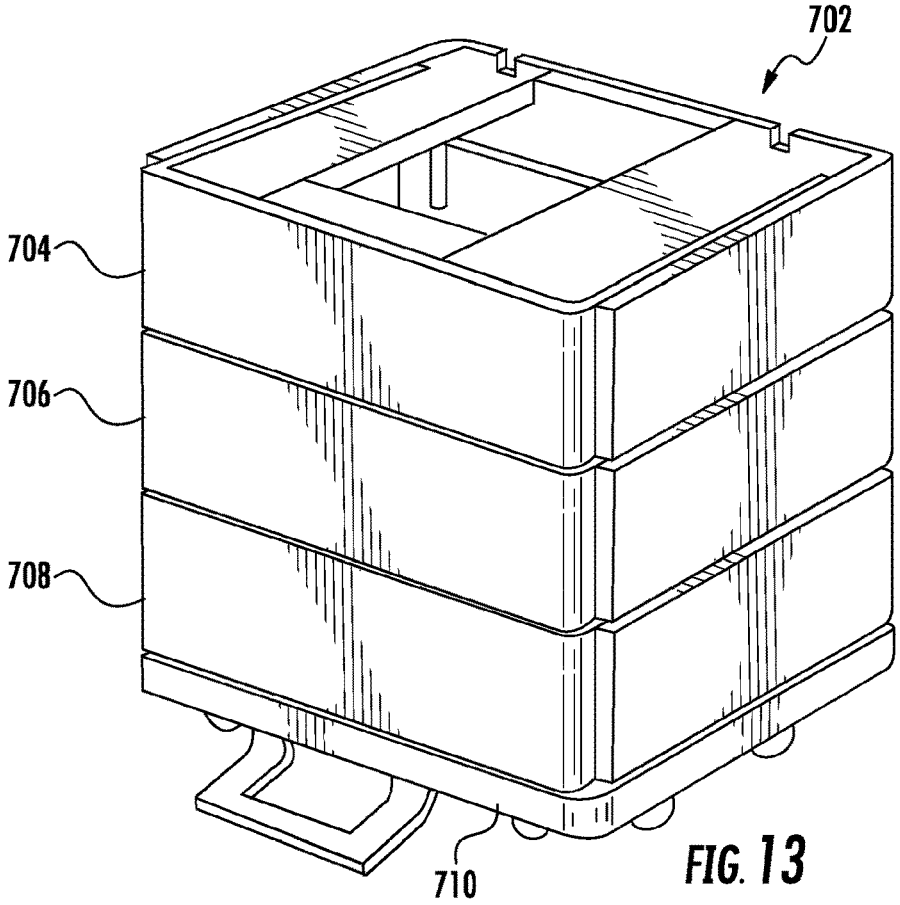
FIG. 13 is a perspective view of an example printer tray accessory.
Figure 14:
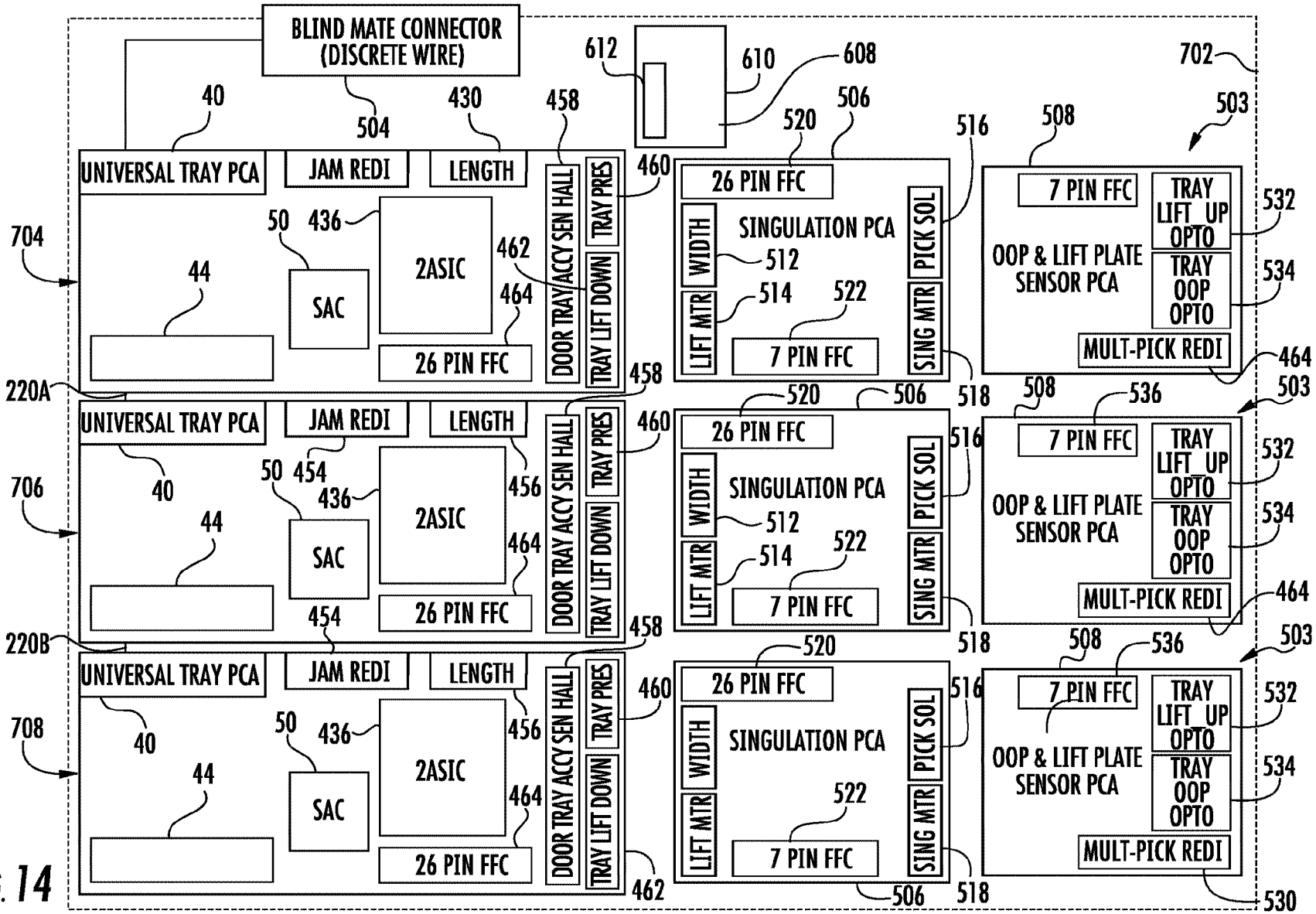
FIG. 14 is a schematic diagram of the example universal printed circuit assembly sets of FIG. 10 and a cart indicating PCA of the printer tray accessory of FIG. 13.

FIGS. 13 and 14 illustrate printer tray accessory 702 for use with main printer 500 shown in FIG. 8. Printer tray accessory 702 comprises three stacked trays 704, 706, 708 on a cart 710. As schematically illustrated by FIG. 14, each of the printer trays 704, 706 and 708 has an associated universal set 503 that facilitates control and communication for the associated tray. Each set comprises PT PCA 430, singulation PCA 506 and an OOP and lift plate PCA 508 (described above). In addition, accessory 702 comprises a cart indicating PCA 608 (described above).

As further shown by FIG. 14, the multiple PT PCAs 430 of the different universal sets 503 are connected in series by interconnects 220A, 220B. As described above with respect to FIG. 5, interconnects 220A and 220B cause SAC 50 of the PT PCAs 430 associated with trays 704 and 706 to alter the signal output by printer tray accessory 702 to main printer 500 (shown in FIG. 8). This altered signal indicates to main printer 500 the configuration of printer tray accessory 702.

Figure 15:
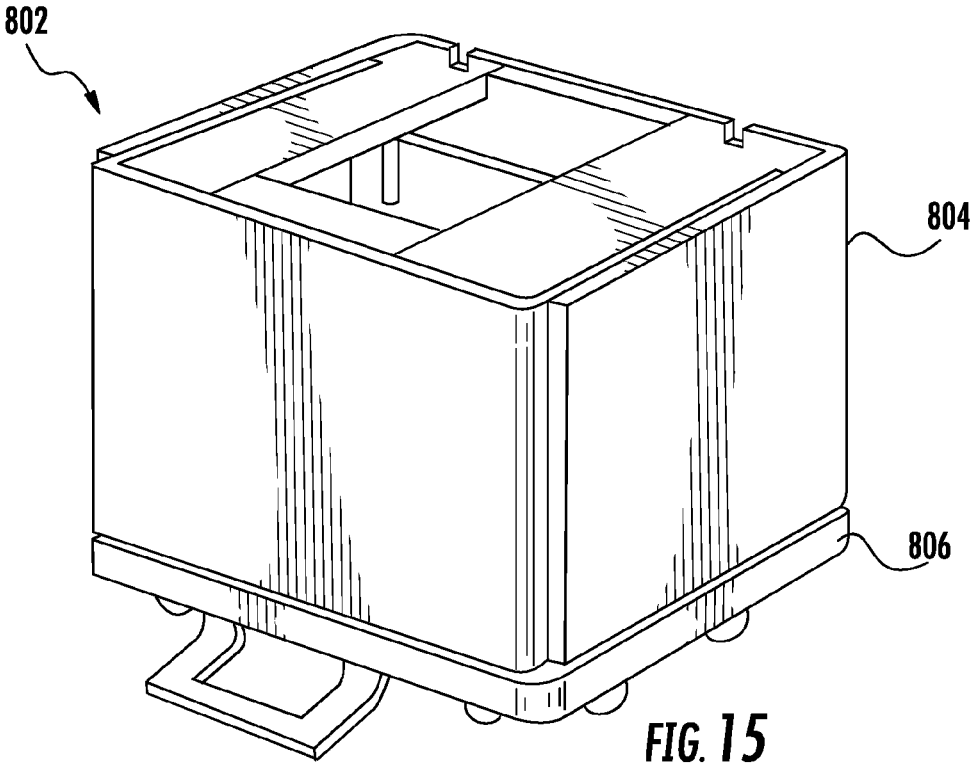
FIG. 15 is a perspective view of an example printer tray accessory.
Figure 16:
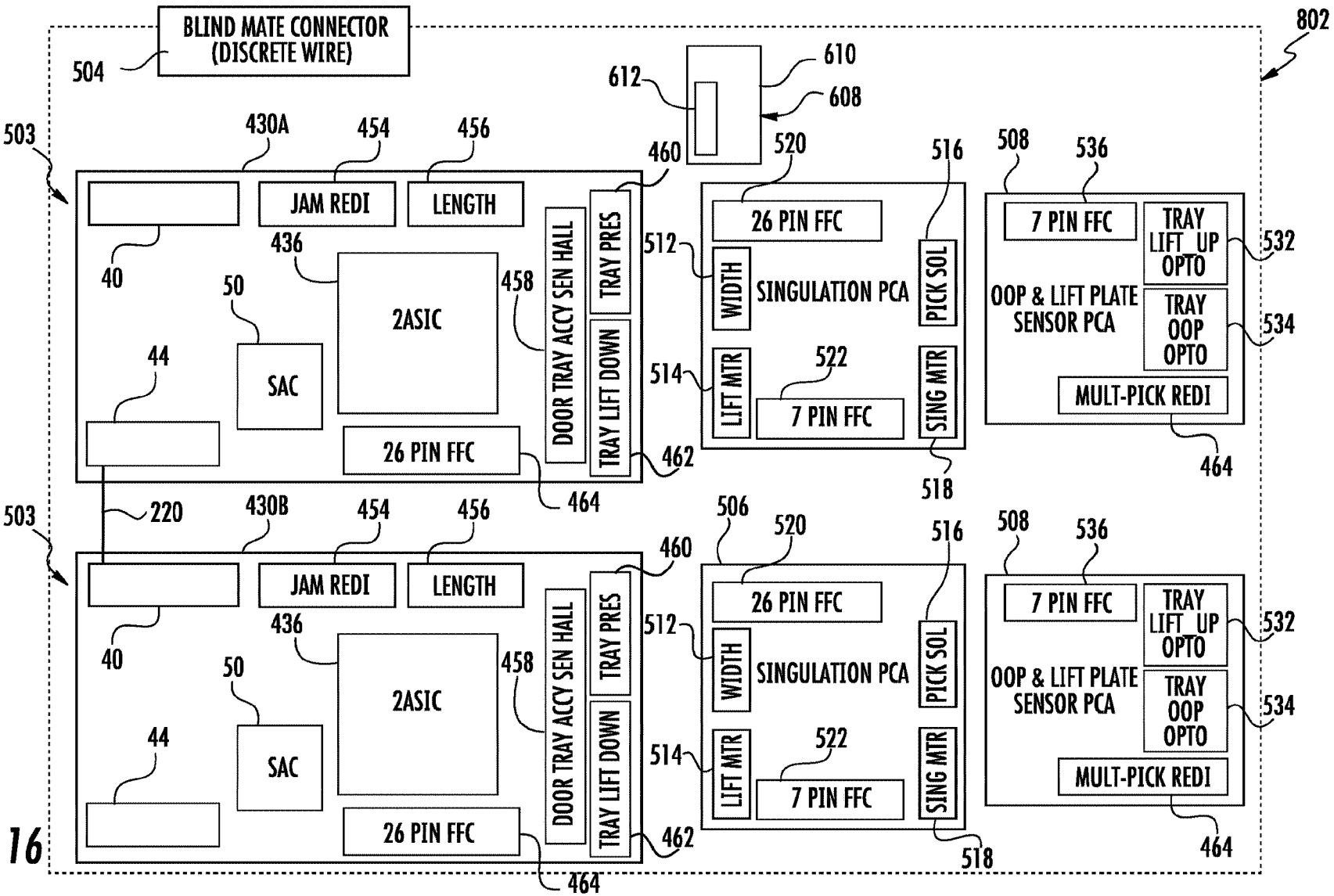
FIG. 16 is a schematic diagram of the example universal printed circuit assembly sets of FIG. 10 and a cart indicating PCA of the printer tray accessory of FIG. 16.

FIGS. 15 and 16 illustrate printer tray accessory 802 for use with main printer 500. Printer tray accessory 802 comprises a high-capacity printer tray 804 and a supporting cart 806. High-capacity printer tray 804 has a larger capacity for containing a larger number of sheets as compared to the individual trays 704, 706, 708.

As schematically shown by FIG. 16, printer tray accessory 802 comprises a pair of universal PCA sets 503 having PT PCAs 430A, 430B connected in series by interconnect 220. As printer tray accessory 802 comprises a cart 806, printer tray accessory 802 further comprises the cart indicating PCA 608 (described above). As described above, the mere connection of interconnect 220 to input connector 44 of PT PCA 430B causes SAC 50, 150 of PT PCA 430A to alter the signal being output by a printer tray accessory indicating electrical contact element of output connector 40. As a result, main printer 500 (shown in FIG. 8) is provided with an indication of the particular configuration of printer tray accessory 802, facilitating proper control and communication of printer tray accessory 802 by main printer 500.

Figure 17:
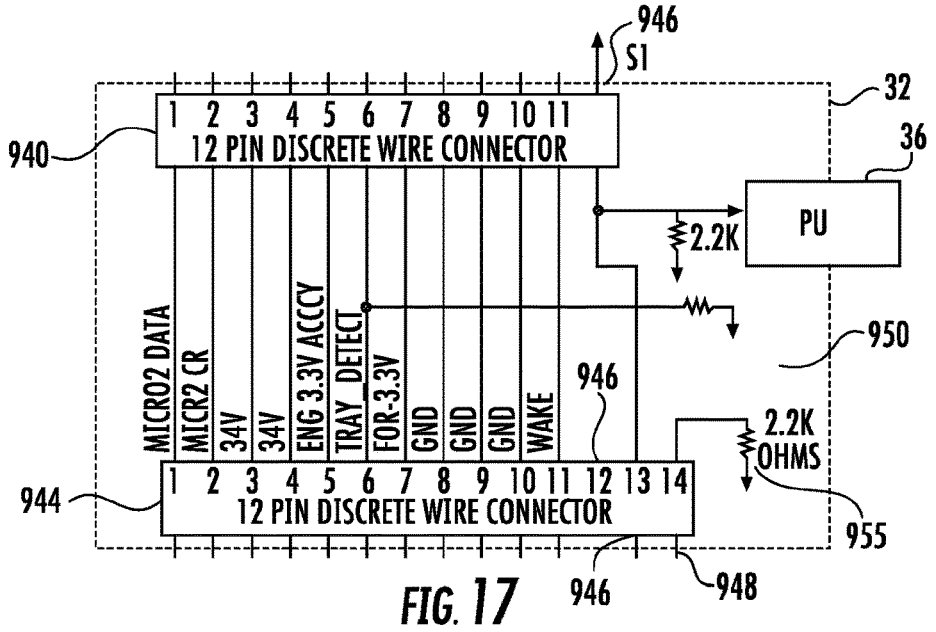
FIG. 17 is a schematic diagram of a portion of an example PT PCA.

FIG. 17 is a schematic diagram of a portion of an example PT PCA 930. PT PCA 930 may be employed in place of any of PT PCAs 30, 430 described above. PT PCA 930 comprises circuit board 32, processing unit 36, output connector 940, input connector 944 and signal altering circuitry 950. Circuit board 32 and processing unit 36 are described above. In one implementation, processing unit 36 may comprise an ASIC such as the processing unit 436.

Output connector 940 is similar to output connector 40 described above except that output connector 940 is specifically illustrated as comprising a 12 pin discrete wire connector. Likewise, input connector 944 is similar to input connector 44 described above except that input connector 944 is specifically illustrated as comprising a 14 pin discrete wire connector. In the example illustrated, connectors 940 and 944 are connected to one another across board 32, providing electrical connections across board 32. The various pins of connectors 940 and 944 transmit various signals or provide various electrical connections between connector connectors 940 and 944 such as data signals, clock signals, tray detection signals, ground signals and wake signals. In the example illustrated, both output connector 940 and input connector 944 comprise a tray identification electrical contact element 946 (shown as a pin 12) which communicates an identification or configuration of the printer tray accessory to a main printer. In the example illustrated, input connector 944 comprises an additional SAC connecting pin 948. SAC connecting pin 948 is connected to SAC 950. As will be described hereafter, pin 946 and 948 are disconnected from one another in the absence of PT PCA 930 being connected to an interconnect, isolating SAC 950.

SAC 950 is similar to SAC 50 in that SAC 950 comprises electrical circuitry or electronics carried by board 32 to automatically alter an output signal of the output connector in response to the input connector being connected to the interconnect, the altered output signal indicating a configuration of a printer tray configuration. In the example illustrated, SAC 950 comprises signal altering circuitry that is electrically isolated from the tray circuitry that includes processing unit 36, output connector 940 and input connector 944, wherein SAC 950 is connectable to the tray circuitry in response to input connector 944 being connected to the interconnect. Connection of SAC 50 to the remaining tray circuitry results in the signal being output at the tray configuration indicating electrical contact element or pin 946 of output connector 940 being altered.

In the example illustrated, SAC 950 comprises an electrical resistor 955 connected to and between SAC connecting pin 948 and ground. When an interconnect is connected to input connector 944, connecting pins 946 and 948 are connected to one another such that the electrical resistor 955 is placed in parallel so as to alter the voltage seen by main printer 500 at pin 946 of output connector 940. In other implementations, SAC 50 may comprise additional resistors or other electronic components that when connected to pin 946 by an interconnect so as to alter the voltage characteristic or other signal characteristic seen by main printer 500 at pin 946 of output connector 940.

Figure 18:
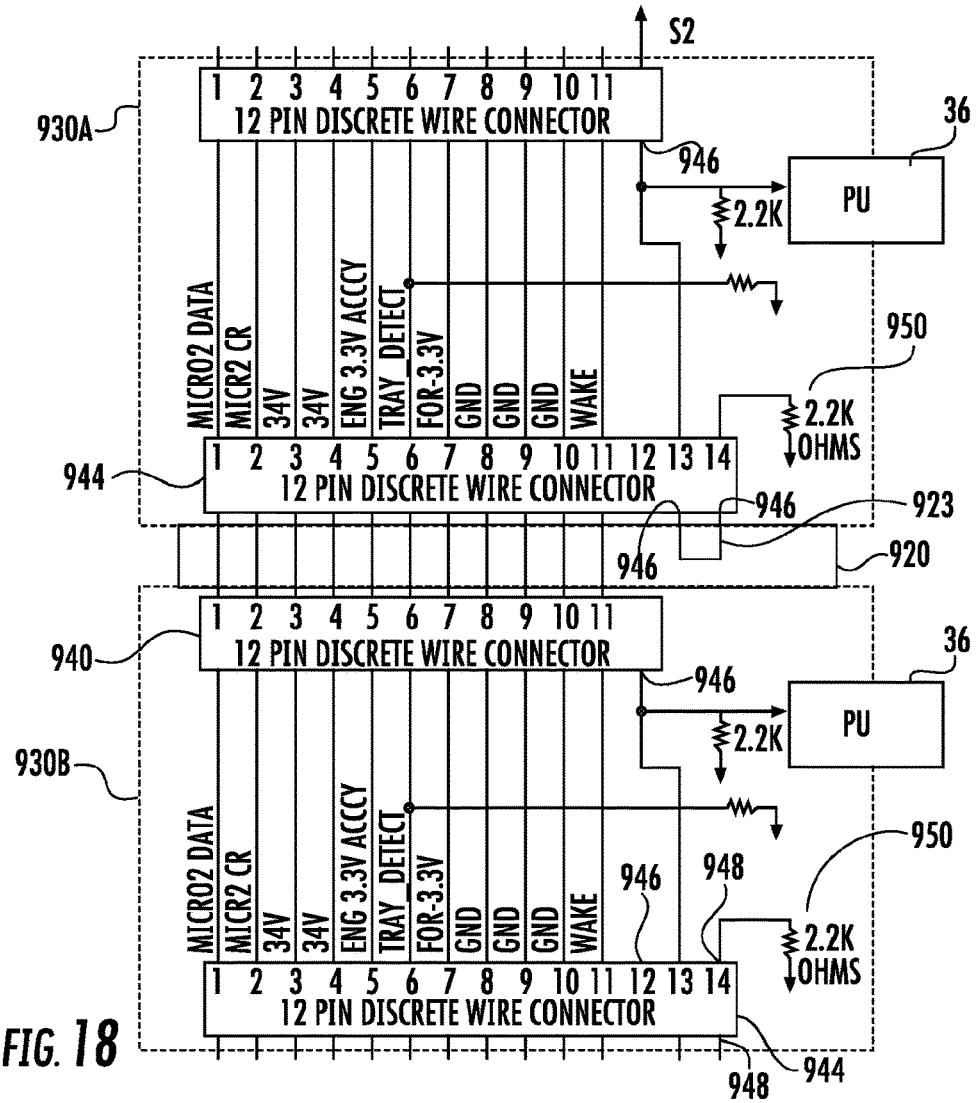
FIG. 18 is a schematic diagram of portions of two example PT PCAs connected in series by an interconnect.

FIG. 18 illustrates two PT PCAs 930A, 930B connected in series by interconnect 920. Each of PT PCAs 930A, 930B is identical to the PT PCA 930 described in FIG. 17. Each of PT PCAs 930A, 930B is associated with a distinct tray provided as part of a single printer tray accessory for a main printer, such as main printer 500 (shown in FIG. 8). For example, each of PT PCAs 930A, 930B may be provided as part of a universal PCA set such as for tray accessory 802 described above.

Figure 19:
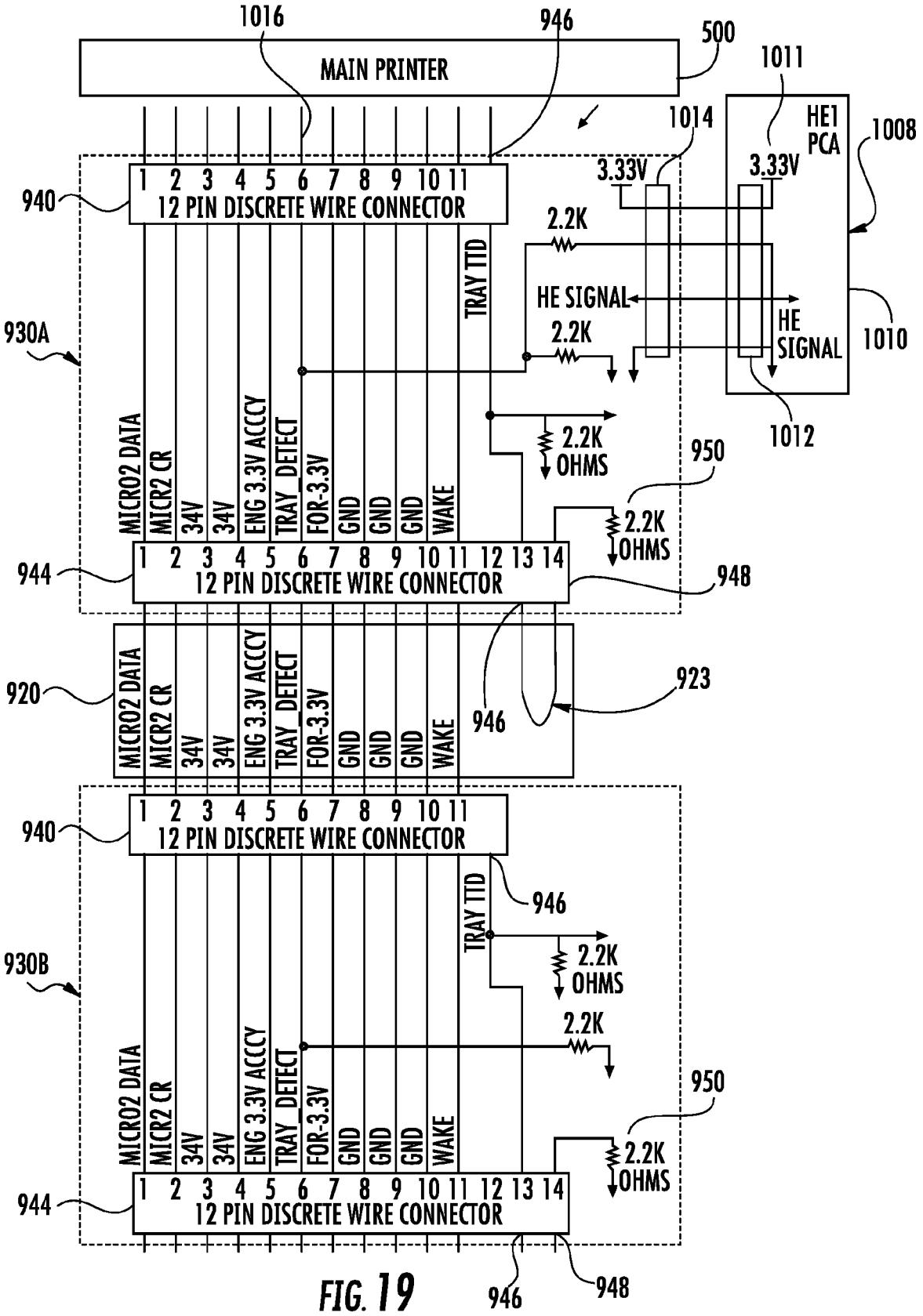
FIG. 19 is a schematic diagram of portions of two example PT PCAs connected in series by an interconnect with the two example PT PCAs connected to a cart indicating PCA and connected to a printer.

FIG. 19 illustrates portions of the two PT PCAs 930A, 930B of FIG. 18 connected in series by interconnect 920 and connected to main printer 500, wherein the printer tray accessory further comprises an example cart indicating PCA 1008, an example implementation of cart indicating PCA 608 described above. Cart indicating PCA 608 is provided with PT PCAs 930A and 930B when the associated printer tray accessory comprises a cart supporting the two printer trays associated with PT PCAs 930A and 930B. In the example illustrated, cart indicating PCA 1008 comprises a circuit board 1010 supporting a voltage source 1011 and a connector 1012 that is connected to a connector 1014 added to PT PCA 930A. The voltage signal transmitted to connector 1014 is further transmitted to a tray detection pin 1016 of output connector 940. The voltage signal provided at pin 1016 indicates the main printer 500 that the tray accessory identified by the signal at pin 946 of PT PCA 930A additionally is supported by a cart.

Figure 20:
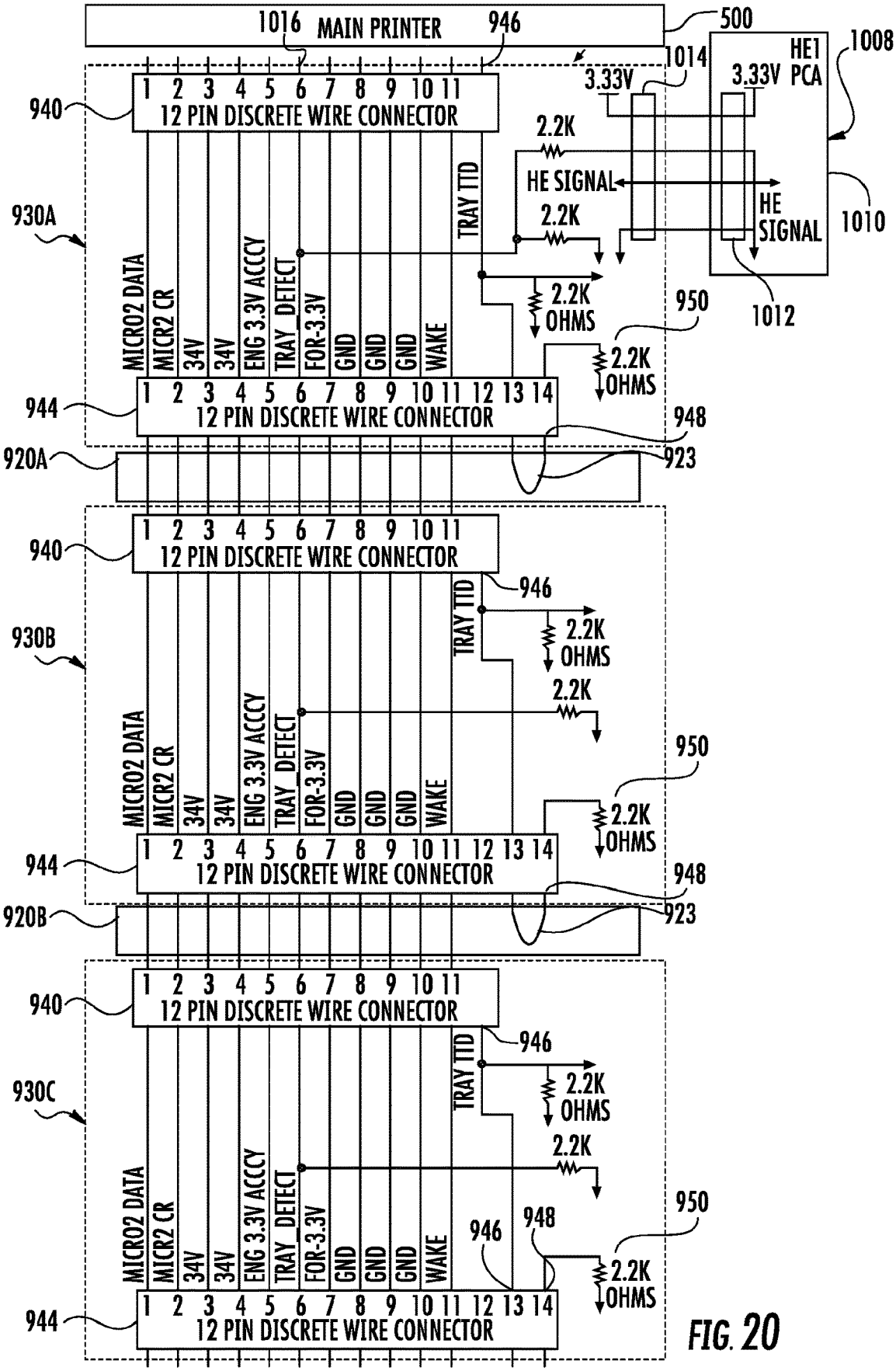
FIG. 20 is a schematic diagram of portions of three example PT PCAs connected in series by an interconnect with the three example PT PCAs connected to a cart indicating PCA and connected to a printer.

FIG. 20 illustrates portions of three PT PCAs 930A, 930B and 930C connected in series by interconnects 920A and 920B. Each of PT PCAs 930A, 930B and 930C is associated with a different printer tray of a single printer tray accessory. As described above with respect to FIG. 5 and FIG. 14, interconnects 920A and 920B alter the output signals of the PT PCAs to which they are connected. Interconnect 920B connects pins 946 and 948 of PT PCA 930B, connecting the SAC 950 of PT PCA 930B. Likewise, interconnect 920A connects pins 946 and 948 of PT PCA 930A, connecting the SAC 950 of PT PCA 930A. The two connected SACs 950 alter printer tray accessory configuration signal output at pin 946 of output connector 940 of PT PCA 930A so as to indicate to main printer 500 that the particular printer tray accessory has a configuration that includes three printer trays. In the example illustrated, the particular printer tray accessory further includes a cart. The presence of the cart is indicated by the signal received by main printer 500 at pin 1016 as provided by cart indicating PCA 1008, described above.

Although the present disclosure has been described with reference to example implementations, workers skilled in the art will recognize that changes may be made in form and detail without departing from the spirit and scope of the claimed subject matter. For example, although different example implementations may have been described as including one or more features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. An apparatus comprising:

a first printer tray printed circuit assembly comprising:

a board;

a processing unit supported by the board;

a first output connector connected to the processing unit and supported by the board, wherein the first output connector is to be connected to a printer;

a first input connector supported by the board, wherein the first input connector is connectable to a first interconnect to connect the first printer tray printed circuit assembly to a second printer tray printed circuit assembly;

a sensor to detect whether the first input connector is connected to the second printer tray printed circuit assembly via the first interconnect; and a first signal altering circuitry carried by the board, wherein the first signal altering circuitry automatically alters an output signal of the first output connector from a first voltage to a second voltage in response to the sensor detecting that the first input connector is connected to the second printer tray printed circuit assembly via the first interconnect, wherein the altered output signal of the first output connector indicates to the printer that two printer trays are connected to the printer.

2. The apparatus of claim 1, further comprising:

a first print media tray to supply print media to the printer, the first print media tray carrying the first printer tray printed circuit assembly.

3. The apparatus of claim 2, further comprising:

a stand indicating printed circuit assembly connected to the first output connector to alter a voltage of at least one connector pin of the first output connector to indicate a presence of a stand supporting the first print media tray.

4. The apparatus of claim 1, wherein the first signal altering circuitry is isolated from the first output connector when the first input connector is not connected to the second printer tray printed circuit assembly, and wherein the first signal altering circuitry is connected to the first output connector to alter the output signal of the first output connector when the first input connector is connected to the second printer tray printed circuit assembly.

5. The apparatus of claim 1, further comprising the second printer tray printed circuit assembly, the second printer tray printed circuit assembly comprising:

a second board;

a second processing unit supported by the second board;

a second output connector connected to the second processing unit and supported by the board;

a second input connector supported by the second board, wherein the second input connector is connectable to a second interconnect to connect the second printer tray printed circuit assembly to a third printer tray printed circuit assembly; and a second signal altering circuitry carried by the second board, wherein the second signal altering circuitry automatically alters an output signal of the second output connector in response to a detection that the second input connector is connected to the third printer tray printed circuit assembly via the second interconnect, the altered output signal of the second output connector indicating to the printer a configuration of a printer tray configuration.

6. The apparatus of claim 5, further comprising:

a first print media tray to supply print media to the printer, the first print media tray carrying the first printer tray printed circuit assembly; and a second print media tray to supply print media to the printer, the second print media tray carrying the second printer tray printed circuit assembly.

7. The apparatus of claim 5, wherein the second interconnect is releasably connected to the second input connector.

8. The apparatus of claim 5, wherein the first printer tray printed circuit assembly and the second printer tray printed circuit assembly are identical.

9. The apparatus of claim 5, wherein the second interconnect is fixedly connected to the second input connector.

10. The apparatus of claim 1, wherein the first input connector comprises:

a first connection element connected to a corresponding output connection element of the first output connector; and a second connection element releasably connected to the first signal altering circuitry, wherein the first interconnect connects the first connection element to the second connection element when the first interconnect is connected to the first input connector.

11. A printer tray accessory for use with a printer, the printer tray accessory comprising:

a first tray carrying a first tray printed circuit assembly to be connected to the printer;

a second tray carrying a second tray printed circuit assembly to be connected to the first tray printed circuit assembly via an interconnect, wherein the second tray printed circuit assembly is to communicate with the printer across the interconnect connecting the second tray printed circuit assembly to the first tray printed circuit assembly and across the first tray printed circuit assembly;

a sensor to detect whether the first input connector is connected to the second printer tray printed circuit assembly via the first interconnect; and a signal altering circuitry (SAC), wherein in response to the sensor detecting that the second tray printed circuit assembly is connected to the first tray printed circuit assembly via the interconnect, the SAC alters an output signal of the first tray printed circuit assembly from a first voltage to a second voltage such that the altered output signal indicates to the printer that the printer tray accessory has two trays being connected to the printer.

12. The printer tray accessory of claim 11, wherein the first tray printed circuit assembly comprises:

a first input pin connected to a corresponding output pin; and a second input pin releasably connected to the SAC, wherein the interconnect connects the first input pin to the second input pin when the interconnect is connected to the first tray printed circuit assembly.

13. A method for operating a printer tray accessory to communicate with a printer, wherein the printer tray accessory includes a first printer tray printed circuit assembly, a second printer tray printed circuit assembly, an interconnect for connecting the second printer tray printed circuit assembly to the first printer tray printed circuit assembly, a sensor, and a signal altering circuitry, the method comprising:

detecting, by the sensor, that the first printer tray printed circuit assembly is connected to the second printer tray printed circuit assembly via the interconnect;

in response to the sensor detecting that the first printer tray printed circuit assembly is connected to the second printer tray printed circuit assembly via the interconnect, altering, by the signal altering circuitry, an output signal of the first printer tray printed circuit assembly from a first voltage to a second voltage to indicate to the printer that the printer tray accessory has two printer trays being connected to the printer; and communicating, by the second printer tray printed circuit assembly, with the printer via the interconnect and via the first printer tray printed circuit assembly.

14. The method of claim 13 further comprising:

in response to detecting that the second printer tray printed circuit assembly is connected to a third printer tray printed circuit assembly via a second interconnect, altering the output signal of the first printer tray printed circuit assembly to a third voltage to indicate to the printer that the printer tray accessory has three printer trays being connected to the printer.

15. The method of claim 13, wherein the first tray printed circuit assembly comprises:

a first input pin connected to a corresponding output pin; and a second input pin releasably connected to the signal altering circuitry, wherein the connecting of the second tray printed circuit assembly to the first tray printed circuit assembly by the interconnect connects the first input pin to the second input pin.

* * * * *